US006118356A

United States Patent [19]

Loi et al.

[11] Patent Number: 6,118,356

[45] Date of Patent: Sep. 12, 2000

[54] MICROWAVE CAVITY HAVING A REMOVABLE END WALL

[75] Inventors: Keith N. Loi, Rosemead; Paul J. Tatomir, Laguna Niguel, both of Calif.; Franz D. Davis, Annapolis, Md.; Robert J. Ahulii, Torrance; James W. Schultz, Redondo Beach, both of Calif.

[73] Assignee: Hughes Electronics Corporation, El Segundo, Calif.

[21] Appl. No.: 09/154,488

[22] Filed: Sep. 16, 1998

[51] Int. Cl.[7] ..... H01P 1/20; H01P 1/208; H01P 7/06; H01P 7/10

[52] U.S. Cl. ..... 333/209; 333/233; 333/235; 333/219.1; 333/224

[58] Field of Search ..... 333/202, 209, 333/219.1, 223–226, 231–233, 235

[56] References Cited

U.S. PATENT DOCUMENTS

| | | | |
|---|---|---|---|
| 2,890,421 | 6/1959 | Currie | 333/208 |
| 3,247,475 | 4/1966 | Buetow et al. | 333/231 |
| 3,618,135 | 11/1971 | Weller | 333/232 |
| 4,035,749 | 7/1977 | Slocum et al. | 333/232 |
| 4,207,548 | 6/1980 | Graham et al. | 333/225 |
| 4,360,793 | 11/1982 | Rhodes et al. | 333/209 X |
| 4,410,865 | 10/1983 | Young et al. | 333/208 |
| 4,494,093 | 1/1985 | Owlett | 333/232 |
| 4,639,690 | 1/1987 | Lewis | 333/231 X |
| 4,647,883 | 3/1987 | Oxley | 333/245 |
| 4,673,894 | 6/1987 | Rogers | 333/230 X |
| 4,706,053 | 11/1987 | Giavarini | 333/233 X |
| 4,728,913 | 3/1988 | Ishikawa et al. | 333/235 |
| 5,105,174 | 4/1992 | Cruchon et al. | 333/209 |
| 5,218,330 | 6/1993 | Omiya et al. | 333/223 |
| 5,243,310 | 9/1993 | Calco | 333/233 |
| 5,825,267 | 10/1998 | Smith | 333/202 X |

FOREIGN PATENT DOCUMENTS

| | | | |
|---|---|---|---|
| 1-151302 | 6/1989 | Japan | 333/219.1 |
| 1555727 | 4/1990 | U.S.S.R. | 333/202 |

*Primary Examiner*—Robert Pascal
*Assistant Examiner*—Barbara Summons
*Attorney, Agent, or Firm*—T. Gudmestad; M. W. Sales

[57] ABSTRACT

A plurality of end caps engagable with a microwave cavity each have an underside configured differently to cause the microwave cavity to have different electrical responses depending on which end cap engages the microwave cavity. A microwave device includes a cylindrical cavity and an end cap movable within the cavity to change its axial position within the cavity thereby varying the volume and the electrical response of the cavity.

19 Claims, 2 Drawing Sheets

MICROWAVE CAVITY HAVING A REMOVABLE END WALL

TECHNICAL FIELD

The present invention relates generally to microwave cavities and, more particularly, to a microwave cavity having a removable end wall.

BACKGROUND ART

A variety of microwave devices such as frequency modulated oscillators, amplifiers, filters, resonators, wavemeters, etc. include a waveguide or other microwave cavity supporting electromagnetic waves. The electromagnetic waves resonate in the cavity at a resonant frequency. The cavity may be tuned with a metallic screw, probe, or other sliding short circuit type of plunger that extends through a wall thereof to change the resonant frequency.

A problem with a conventional tuning element is that at least some portion of the tuning element and/or the driving unit for driving the tuning element extends out of the cavity for operator access. For example, a sliding plunger inside a cavity is connected to a drive unit outside of the cavity. As another example, a tuning screw extending inside a cavity includes a portion extending out of the cavity. Accordingly, the total volume of the cavity and the tuning element is unnecessarily large. Further, the portions extending out of the cavity may be exposed to accidental contact which can change the tune of the cavity.

Furthermore, conventional tuning elements lack the ability to be removed and replaced with another tuning element having a different configuration for controlling the electrical response of a cavity. For instance, by using tuning elements with different configurations, the passband characteristics of a cavity can be quickly changed. Further, by using tuning elements with different configurations and then securing these tuning elements to a common position relative to a cavity, the passband characteristics of the cavity can be changed even quicker.

Previously, more piece parts and structure were needed to be used for a given cavity. Consequently, at times, entire units have to be scrapped because of limited frequency flexibility due to physical inflexibility.

SUMMARY OF THE INVENTION

Accordingly, it is an object of the present invention to provide a microwave cavity having a removable end cap.

It is a further object of the present invention to provide a plurality of end caps having different underside configurations for a microwave cavity.

It is another object of the present invention to provide a plurality of removable end caps having different underside configurations and are securable to a common position relative to a cylindrical microwave cavity.

In carrying out the above objects and other objects, the present invention provides a plurality of end caps engagable with a microwave cavity. Each of the end caps has an underside. The undersides of the end caps are configured differently to cause the microwave cavity to have different electrical responses depending on which end cap engages the microwave cavity.

Further, in carrying out the above objects and other objects, the present invention provides a microwave device. The microwave device includes a cylindrical cavity having a threaded surface and an end cap having an outer threaded surface cooperative with the threaded surface of the cavity to enable removal and insertion of the end cap within the cavity. The threaded surfaces are further cooperative to enable movement of the end cap within the cylindrical cavity to change its axial position within the cavity thereby varying the volume and the electrical response of the cavity.

Still further, in accordance with the present invention, a microwave filter system employing the microwave device described above is provided.

The advantages accruing to the present invention are numerous. A microwave cavity can be altered by changing a small piece instead of altering an entire cavity. Tunability of a microwave cavity is more feasible and quicker by using end caps with different underside configurations and securing these end caps to a common position relative to the cavity. Individual cavity resonator quality factors can be easily controlled by end cap underside configurations. Thus, passband characteristics of the cavity can be shaped to meet various requirements. Another benefit is that a cavity can be easily disassembled and reassembled with less detriment to the electrical response of the cavity than with conventional tuning systems. Furthermore, the end cap can also be designed to provide a passive intermodulation (PIM) free junction. Another feature of the end caps is that their use significantly decreases radio frequency (RF) leakage of a cavity.

These and other features, aspects, and embodiments of the present invention will become better understood with regard to the following description, appended claims, and accompanying drawings.

BEST MODES FOR CARRYING OUT THE INVENTION

Figure 1:
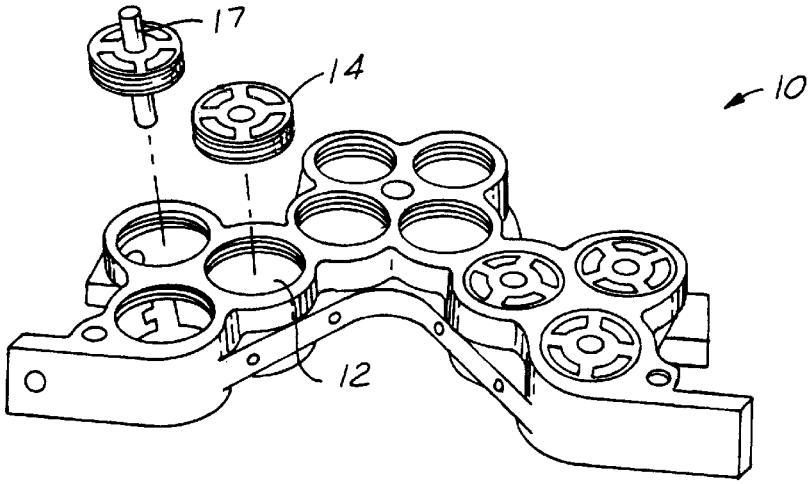
FIG. 1 is a perspective view of a microwave filter system having a plurality of cylindrical cavities in accordance with the present invention.

Referring now to FIG. 1, a microwave filter system 10 in accordance with the present invention is shown. Filter system 10 includes a plurality of cylindrical cavities 12 with associated end caps 14. Cylindrical cavities 12 and end caps 14 are formed from metallic electrically conducting metals. Cylindrical cavities 12 are coupled (not specifically shown)

to filter microwave energy input at one end of filter system 10 and then output at another end of the filter system. Cylindrical cavities 12 can be tuned by end caps 14 to generate different individual electrical responses such that the electrical response of filter system 10 is variable.

Figure 2:
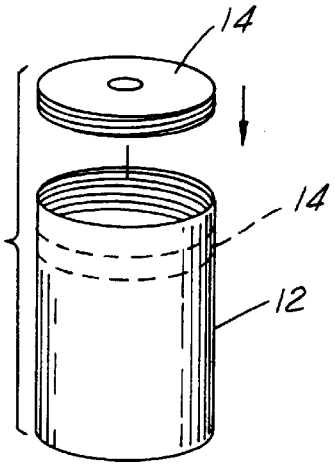
FIG. 2 is a side view of a removable end cap above a cylindrical cavity and is also a side view of the end cap shown in phantom within the cavity.
Figure 3:
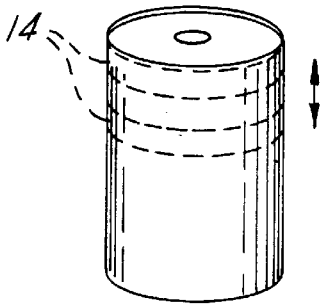
FIG. 3 is a side view of the end cap shown in phantom at two different axial positions within the cylindrical cavity and illustrates the capability of the end cap to axially move within the cavity.

Turning now to FIGS. 2 and 3, end cap 14 is removable from cylindrical cavity 12. As will be described later, end cap 14 can be removed from cylindrical cavity 12 and then another end cap having a different underside can be inserted into the cavity. For instance, the undersides may be different by being recessed to different depths. The axial position of end cap 14 may also be adjusted within cylindrical cavity 12 to vary the electrical response of the cavity. By changing the axial position of end cap 12 within cylindrical cavity 12, the volume of the cavity changes. Changing the volume of cylindrical cavity 12 changes the electrical response of the cavity. Further, the volume and the electrical response of cylindrical cavity 12 changes between end caps placed at the same axial position having different undersides.

Figure 4:
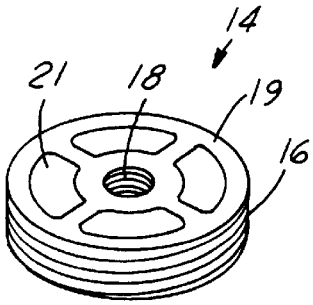
FIG. 4 is a perspective view of an end cap.

Looking now to FIG. 4, end cap 14 includes a threaded outer surface 16. Outer surface 16 mates with the threads of cylindrical cavity 12 to enable adjustment of the axial position of end cap 14 in the cavity by rotating the end cap. End cap 14 further includes a threaded inner receiving aperture 18. Receiving aperture 18 is capable of receiving a tuning element such as a screw for fine tuning cylindrical cavity 12 once end cap 14 is secured to a given axial position. End cap 14 also includes a top side 19 with four recessed portions 21 to provide access for an operator to rotate the end cap.

Figure 5:
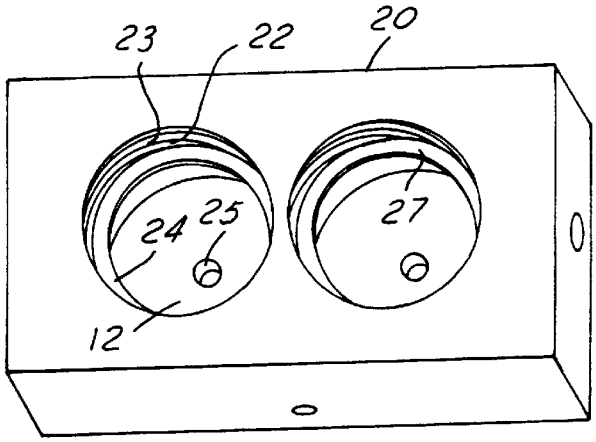
FIG. 5 is a perspective view of a portion of the housing of the microwave filter system shown in FIG. 1.

Referring now to FIG. 5, a housing body 20 of filter system 10 is shown. Cylindrical cavity 12 is formed within housing body 20. Cylindrical cavity 12 includes a wall 23 having an upper portion with a threaded receiving surface 22 for mating with the threads of outer surface 16 of end cap 14. Cylindrical cavity 12 further includes a projection 24 located beneath receiving surface 22. Projection 24 prevents end cap 14 from moving past a predetermined axial position thereby setting a minimum volume limit of cylindrical cavity 12. Projection 24 also enables end caps having different undersides to be placed at the predetermined axial position. A washer, ring, shim, or the like 27 may be placed on projection 24 to fit between the projection and end cap 14 to move the predetermined axial position upward thereby making cylindrical cavity 12 larger. Cylindrical cavity 12 may also include a dielectric resonator 25 positioned within the cavity.

Figure 6:
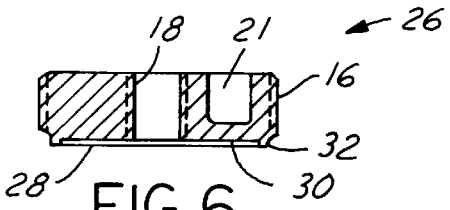
FIG. 6 is a cross-sectional side view of an end cap according to an embodiment of the present invention.
Figure 8:
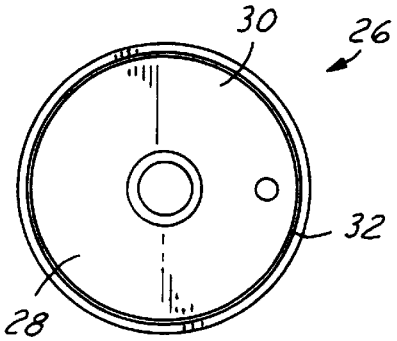
FIG. 8 is a bottom view of the end cap shown in FIG. 6.

Viewing now FIGS. 6 and 8, an end cap 26 according to one embodiment of the present invention is shown. End cap 26 includes threaded outer surface 16 and threaded inner receiving aperture 18. End cap 26 further includes an underside 28. Underside 28 has a recessed portion 30 and a strip portion 32 extending around and out from the recessed portion. Recessed portion 30 is recessed to a given depth. Other end caps useable with cylindrical cavity 12 have recessed portions recessed to different depths. Recessed portion 30 and strip portion 32 define a determined geometric configuration of underside 28. The determined geometric configuration causes cylindrical cavity 12 to have certain electrical response characteristics independent of the axial position of end cap 26 within the cavity.

Figure 7:
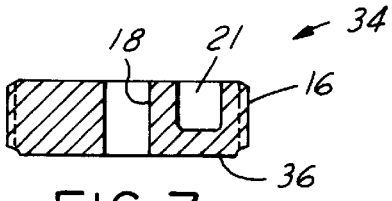
FIG. 7 is a cross-sectional side view of an end cap according to another embodiment of the present invention.
Figure 9:
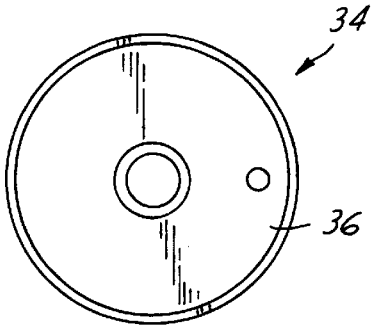
FIG. 9 is a bottom view of the end cap shown in FIG. 7.

Viewing now FIGS. 7 and 9, an end cap 34 according to another embodiment of the present invention is shown. End cap 34 includes threaded outer surface 16 and threaded inner receiving aperture 18. End cap 26 further includes an underside 36. Unlike underside 28, underside 36 does not include a recessed portion. Thus, underside 36 defines a determined geometric configuration. The determined geometric configuration causes cylindrical cavity 12 to have certain electrical response characteristics independent of the axial position of end cap 34 within the cavity. End cap 34, like end cap 26, preferably includes a cavity outgassing port 38.

As shown, by tightening down end caps having different undersides to the predetermined axial position set by projection 24, the electrical response of cylindrical cavity 12 can be changed by the end caps with different undersides. Thus, the electrical response of cylindrical cavity 12 can be altered by simply choosing an end cap 14 with a suitable underside and then position the end cap to a predetermined axial position. Of course, if desired, the axial position of end cap 14 can be changed to change the electrical response of cylindrical cavity 12.

Figure 10:
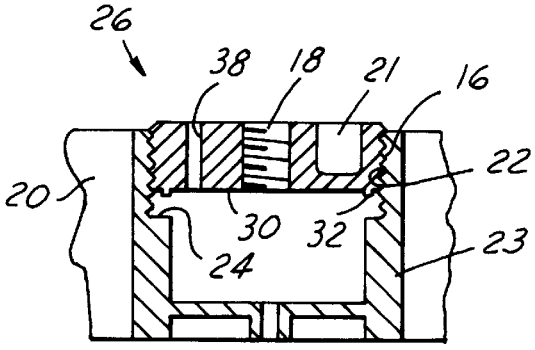
FIG. 10 is a cross-sectional view of an end cap threaded into a cylindrical cavity.
Figure 11:
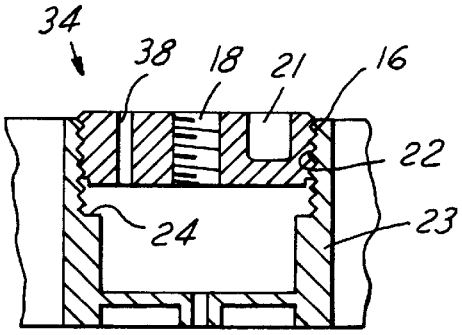
FIG. 11 is a side view of the end cap threaded into the cylindrical cavity as shown in FIG. 10.

Referring now to FIGS. 10 and 11, the cooperation of end cap 14 with cylindrical cavity 12 is shown in further detail. A ridge (not specifically shown) such as strip portion 32 may be on projection 24 of cylindrical cavity 12 for engaging with the strip portion. The ridge engages with strip portion 32 as end cap 26 is tightened down such that the electrical leakage of cavity 12 is decreased as a result of the higher pressure between the ridge and the strip portion.

The present invention is applicable in many microwave applications such as satellite system input and output filter resonators and waveguides. Use of the present invention decreases weight, size, and number of piece parts typically used to form a tunable microwave cavity while improving overall electrical characteristics of the cavity. The present invention has been found to be valuable for devices employing the cylindrical $TE_{011}$ mode and the $TE_{018}$ dielectric resonator mode.

Thus it is apparent that there has been provided, in accordance with the present invention, a microwave cavity having a removable end wall that fully satisfies the objects, aims, and advantages set forth above.

While the present invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A plurality of end caps engagable with a microwave cavity, each of the end caps having an underside facing the microwave cavity, wherein the undersides of the end caps are configured differently to cause the microwave cavity to have different electrical responses depending on which end cap engages the microwave cavity.

2. The end caps of claim 1 wherein:

the undersides of the end caps are recessed to different depths.

3. The end caps of claim 1 wherein:

the end caps are engagable with a cylindrical microwave cavity having a threaded surface, wherein the end caps have an outer threaded surface cooperative with the threaded surface of the cylindrical cavity to enable the end caps to be removed and inserted within the cylindrical cavity and further cooperative to enable the the end caps to be moved within the cylindrical cavity thereby varying the volume and the electrical response of the cylindrical cavity.

4. The end caps of claim 3 wherein:

the cylindrical cavity includes a projection below its threaded surface which is engageable with the end caps to set a predetermined axial position for the end caps.

5. The end caps of claim 1 further comprising:

an inner receiving aperture for receiving a tuning element.

6. The end caps of claim 1 further comprising:

a cavity outgassing port in the end cap.

7. A microwave device comprising:

a cylindrical cavity having a cavity threaded surface;

a plurality of end caps, each of the end caps having an end-cap threaded surface cooperative with the cavity threaded surface to enable removal and insertion of the end cap within the cylindrical cavity and further cooperative to enable movement of the end cap within the cylindrical cavity to change its axial position within the cylindrical cavity thereby varying the volume and the electrical response of the cylindrical cavity, each of the end caps being separately engagable with the cavity threaded surface such that each of the end caps has an underside facing the cylindrical cavity when the end cap is engaged to the cavity threaded surface, wherein the undersides of the end caps are configured differently to cause the cylindrical cavity to have different electrical responses depending upon which end cap engages the cylindrical cavity; and an engaged end cap selected from the plurality of end caps and engaged to the cylindrical cavity.

8. The microwave device of claim 7 wherein:

the cylindrical cavity includes a projection below the threaded surface which is engageable with the engaged end cap to set a predetermined axial position for the engaged end cap.

9. The microwave device of claim 8 further comprising:

a washer engagable with the projection to set a different predetermined axial position.

10. The microwave device of claim 7 wherein:

the undersides of the plurality of end caps are recessed to different depths.

11. The microwave device of claim 7 wherein:

the engaged end cap includes an inner receiving aperture for receiving a tuning element.

12. The microwave device of claim 7 wherein:

the engaged end cap includes a cavity outgassing port.

13. The microwave device of claim 7 wherein:

the engaged end cap includes a top side adapted for manipulation by an operator to rotate the engaged end cap for removing and inserting the engaged end cap within the cylindrical cavity and adjusting the axial position of the engaged end cap within the cylindrical cavity.

14. The microwave device of claim 7 further comprising:

a dielectric resonator positioned within the cylindrical cavity.

15. A microwave filter system comprising:

a plurality of electrically coupled cylindrical cavities, where at least one of the cylindrical cavities has a cavity threaded surface;

a plurality of end caps, each of the end caps having an end-cap threaded surface cooperative with the cavity threaded surface to enable removal and insertion of the end cap within the cylindrical cavity and further cooperative to enable movement of the end cap within the cylindrical cavity to change its axial position within the cylindrical cavity thereby varying the volume and the electrical response of the cylindrical cavity, each of the end caps being separately engagable with the cavity threaded surface such that each of the end caps has an underside facing the cylindrical cavity when the end cap is engaged to the cavity threaded surface, wherein the undersides of the end caps are configured differently to cause the cylindrical cavity to have different electrical responses depending upon which end cap engages the cylindrical cavity; and an engaged end cap selected from the plurality of end caps and engaged to one of the cavities having the cavity threaded surface.

16. The filter system of claim 15, wherein the end caps of the plurality of end caps have undersides that are recessed to different depths.

17. The filter system of claim 15, wherein at least some of the end caps of the plurality of end caps comprise an inner receiving aperture for receiving a tuning element.

18. The filter system of claim 15, wherein at least some of the end caps of the plurality of end caps comprise a cavity outgassing port.

19. The filter system of claim 15, further including a dielectric resonator positioned within at least one of the cylindrical cavities.

* * * * *